US006592271B1

(12) United States Patent
Piccinino, Jr. et al.

(10) Patent No.: US 6,592,271 B1
(45) Date of Patent: Jul. 15, 2003

(54) PROCESSING SOLUTION DELIVERY SYSTEM FOR USE WITH A PHOTOGRAPHIC PROCESSOR AND METHOD OF OPERATION

(75) Inventors: Ralph L. Piccinino, Jr., Rush, NY (US); Jeffrey L. Hall, Rochester, NY (US); Daniel C. Davis, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/164,067

(22) Filed: Jun. 5, 2002

(51) Int. Cl.[7] ..... G03D 3/02
(52) U.S. Cl. ..... 396/625; 396/636; 396/626
(58) Field of Search ..... 396/617–626, 396/636; 355/27–29, 40, 41; 430/30 P, 399, 400; 134/64 P, 64 R, 122 P, 122 R

(56) References Cited

U.S. PATENT DOCUMENTS 4,359,279 A * 11/1982 Popoff ..... 396/617
5,502,534 A * 3/1996 Lynch et al. ..... 396/636

* cited by examiner

*Primary Examiner*—D. Rutledge
(74) *Attorney, Agent, or Firm*—David A. Novais

(57) ABSTRACT

A processing solution delivery system and method for a photographic processor includes a plurality of chambers that are adapted to hold a distinct processing solution therein. A manifold is fluidly connected to the chambers and includes an inclined solution passageway. The manifold provides a connection between the chambers and an associated processor. Provided in a spaced manner along the inclined solution passageway are manifold bores which introduce solution at different points along the inclined passageway. With the present invention, it is possible to introduce wash solution at the highest point of the inclined processing path at the end of a processing cycle so as to assure the removal of contaminants from previously supplied solutions. Further, it is possible to introduce a bleach or fixing solution at the lowermost point of the inclined path to effectively and uniformly quench a development reaction.

22 Claims, 10 Drawing Sheets

PROCESSING SOLUTION DELIVERY SYSTEM FOR USE WITH A PHOTOGRAPHIC PROCESSOR AND METHOD OF OPERATION

CROSS REFERENCE TO RELATED APPLICATIONS

The present application is related to the following pending patent applications: U.S. patent application Ser. No. 10/027,382 filed Dec. 21, 2001, entitled PHOTOGRAPHIC PROCESSOR AND METHOD OF OPERATION; U.S. patent application Ser. No. 10/027,454 filed Dec. 21, 2001, entitled A PROCESSING SOLUTION DELIVERY SYSTEM HAVING A SUPPLY TUBE AND LEVEL DETECTION SENSOR UNIT FOR USE WITH A PHOTOGRAPHIC PROCESSOR; U.S. patent application Ser. No. 10/027,381 filed Dec. 21, 2001, entitled PHOTOGRAPHIC PROCESSOR HAVING AN ADJUSTABLE DRUM; U.S. patent application Ser. No. 10/027,432 filed Dec. 21, 2001, entitled CHEMICAL DELIVERY SYSTEM FOR USE WITH A PHOTOGRAPHIC PROCESSOR AND METHOD OF OPERATION and U.S. patent application Ser. No. 10/108,141 filed Mar. 27, 2002, entitled PHOTOGRAPHIC PROCESSOR HAVING SIDE BY SIDE PROCESSING PATHS AND METHOD OF OPERATION.

FIELD OF THE INVENTION

The present invention is directed to a chemical or processing solution delivery system, which may be used in a photographic processor.

BACKGROUND OF THE INVENTION

Photographic processors come in a variety of shapes and sizes from large wholesale photographic processors to small micro-labs. As photographic processors become more and more technologically sophisticated, there is a continued need to make the photographic processor as user-friendly and as maintenance-free as possible.

Currently available photographic processors have one or more of the following shortcomings: (1) the film processing time is relatively long; (2) some photographic processors, because of their size, require a large amount of space; (3) some photographic processors may require an unacceptable amount of developing solution due to the design of the processing tank, and (4) some photographic processors generate an unacceptable amount of processing solution waste due to the design of the processing tank.

One component of photographic processors is a chemical or processing solution delivery system, which provides processing fluids for processing a roll of photographic film. Some conventional chemical delivery systems have one or more of the following shortcomings: (1) the chemical delivery time is unacceptably long due to (a) a processing fluid dilution step, (b) undesirably long heating times, (c) low volumetric flow into or out of the processing drum or reactor, or (d) a combination thereof; (2) some chemical delivery systems, because of their size, require a large amount of space; (3) some chemical delivery systems require an external water source to dilute the concentration of the chemicals used in the chemical delivery system; and (4) some chemical delivery systems require a drain or sewer drain for removal of the processing fluids from the processor.

Furthermore, in a processor such as that disclosed in co-pending U.S. patent application Ser. No. 10/027,382 filed Dec. 21, 2001, the processing times tend to be short. In processors with short processing times, an operator has to make sure that there are no residual chemicals left in the chemical delivery tubes of the processors, since these residual chemicals tend to be a cause of contamination. As an example, one drop of residual fix chemical in a processor with a short processing time and low chemical usage can contaminate a follow-up developer solution.

SUMMARY OF THE INVENTION

Accordingly, the present invention is directed to a chemical or processing solution delivery system, which may be used in a photographic processor and minimizes contamination due to residual chemicals. The present invention is further directed to a process of delivering chemicals or processing solution to a photographic processor using the delivery system.

Therefore, the present invention provides for a processing solution or chemical delivery system which is designed in a manner which facilitates the washing of residual processing solution from components of the delivery system and processor, and minimizes the contamination of later delivered processing solution.

The chemical or processing solution delivery system of the present invention utilizes a manifold having an inclined or slanted path. The manifold provides a fluid connection between chambers which hold the processing solution and an associated processor, and is designed in such a way that the last processing solution of a processing cycle is a wash solution which completely cleans the manifold, to prevent any chance of contamination.

The present invention accordingly provides for a chemical or processing solution delivery system for a photographic processor which comprises a plurality of chambers, with each of the chambers being adapted to hold a distinct processing solution therein; and a manifold fluidly connected to the plurality of chambers, with the manifold having an inclined or slanted solution passageway and a plurality of manifold bores spaced along the inclined solution passageway. Each of the manifold bores extend from a chamber outlet of a respective chamber to the inclined solution passageway. The inclined solution passageway has a closed end at an upper part of the inclined passageway and a manifold outlet at a lower part of the inclined passageway, such that the solution flows in a direction from the upper part to the lower part of the inclined passageway. A first one of the plurality of chambers is adapted to hold a wash solution and deliver the wash solution to a first manifold bore of the plurality of manifold bores that is located at the upper part of the inclined passageway, so that the wash solution travels along substantially an entire length of the inclined passageway from the upper part to the manifold outlet. The delivery system of the present invention further comprises a supply tube that is fluidly connected to the inclined solution passageway and is located at the manifold outlet of the inclined solution passageway to lead the processing solution to an associated processor.

The present invention further provides for a processing solution delivery system for a processor which comprises a first solution flow path having a first length, with the first solution flow path extending from a first chamber adapted to hold washing solution therein to a processor; a second solution flow path having a second length shorter than the first length, with the second solution flow path extending from a second chamber adapted to hold a developer solution therein to the processor; a third solution flow path having a third length shorter than second length, with the third solution flow path extending from a third chamber adapted to hold one of a fixed solution or a bleach solution therein to the processor; and a fourth solution flow path having a fourth length shorter than the third length, with the fourth solution flow path extending from a fourth chamber adapted to hold the other of the fixed solution or the bleach solution therein to the processor.

The present invention further relates to a processing solution delivery system for a processor which comprises a plurality of chambers, with each of the chambers holding a distinct processing solution therein; and a manifold which provides a fluid connection between each of the plurality chambers and an associated processor for delivering processing solution to the associated processor. The manifold comprises an inclined path which includes an upper end and a lower end. Each of the plurality of chambers is adapted to deliver processing solution to different points along the inclined path of the manifold.

The present invention further relates to a photofinishing arrangement which comprises a processor that is adapted to process photographic film; and a processing solution delivery system adapted to deliver processing solution to the processor. The processing solution delivery system comprises a plurality of chambers which are each adapted to hold a distinct processing solution therein; and a manifold fluidly connected to the plurality of chambers. The manifold has an inclined solution passageway and a plurality of manifold bores spaced along the inclined solution passageway. A first one of the plurality of chambers is adapted to hold a wash solution and deliver the wash solution to a first manifold bore of the plurality of manifold bores that is located at an upper part of the inclined passageway, so that the wash solution flows along an entire length of the inclined passageway from a closed end at the upper part of the inclined passageway to an opening at a lower part of the inclined passageway. The processing solution delivery system further comprises a supply tube fluidly connected to the inclined solution passageway and located at the open end of the inclined solution passageway to lead processing solution to the processor.

The present invention further relates to a method of delivering processing solution to a processor which comprises the steps of delivering a developer solution to a first inlet bore located on an inclined path provided within a manifold, with the manifold providing a fluid connection to a processor, such that the developer solution flows within the inclined path in a solution flow direction from the first inlet bore to an outlet located at a lower end of the inclined path; delivering one of a fixed solution or a bleach solution to a second inlet bore located on the inclined path, with the second inlet bore being spaced from the first inlet bore and being located downstream of the first inlet bore with respect to the solution flow direction, such that the one of the fixed solution or bleach solution flows within the inclined path from the second inlet bore to the outlet located at the lower end of the inclined path; delivering the other of the fixed solution or the bleach solution to a third inlet bore located on the inclined path, with the third inlet bore being spaced from the second inlet bore and being located downstream of the second inlet bore with respect to the solution flow direction, such that the other of the fixed solution or the bleach solution flows within the inclined path from the third inlet bore to the outlet; and delivering a wash solution to a fourth inlet bore located at an upper end of the inclined path, with the fourth inlet bore being spaced from the first inlet bore and being located upstream of the first inlet bore with respect to the solution flow direction, such that the wash solution flows within the inclined path from the fourth inlet bore to the outlet located at the lower end of the inclined path, with the wash solution traveling past all of the first, second and third inlet bores along substantially an entire length of the inclined path.

The present invention further relates to a method of processing photographic material which comprises the steps of delivering distinct processing solutions during a processing cycle to different inlets which are spaced along an inclined path, such that the processing solutions flow within the inclined path to an outlet at the lower end of the inclined path; and leading the distinct processing solutions from the outlet of the inclined path to a processor for processing photographic material. In the method of the present invention, a last delivered solution of the processing solutions in the processing cycle is a wash solution. The method further comprises the step of delivering the wash solution to an uppermost inlet of the inlets of the inclined path to clean at least the inclined path and components of the processor at the end of the processing cycle.

These and other features and advantages of the present invention will become apparent after a review of the following detailed description of the disclosed embodiments and the appended claims.

BRIEF DESCRIPTION OF THE DRAWINGS

The present invention is further described with reference to the appended figures, wherein.

DETAILED DESCRIPTION OF THE INVENTION

The present invention is directed to a chemical delivery system which may be used with a photographic processor. The chemical delivery system of the present invention comprises one or more components for storing, transporting, and collecting processing fluids or solutions, such as processing fluids or solutions used in a photographic processor.

The present invention is further directed to a method of delivering chemicals, fluids or solutions to a processor, such as a photographic processor drum or tank using the chemical delivery system described below. An exemplary chemical delivery system 10 is shown in FIG. 1.

Figure 1:
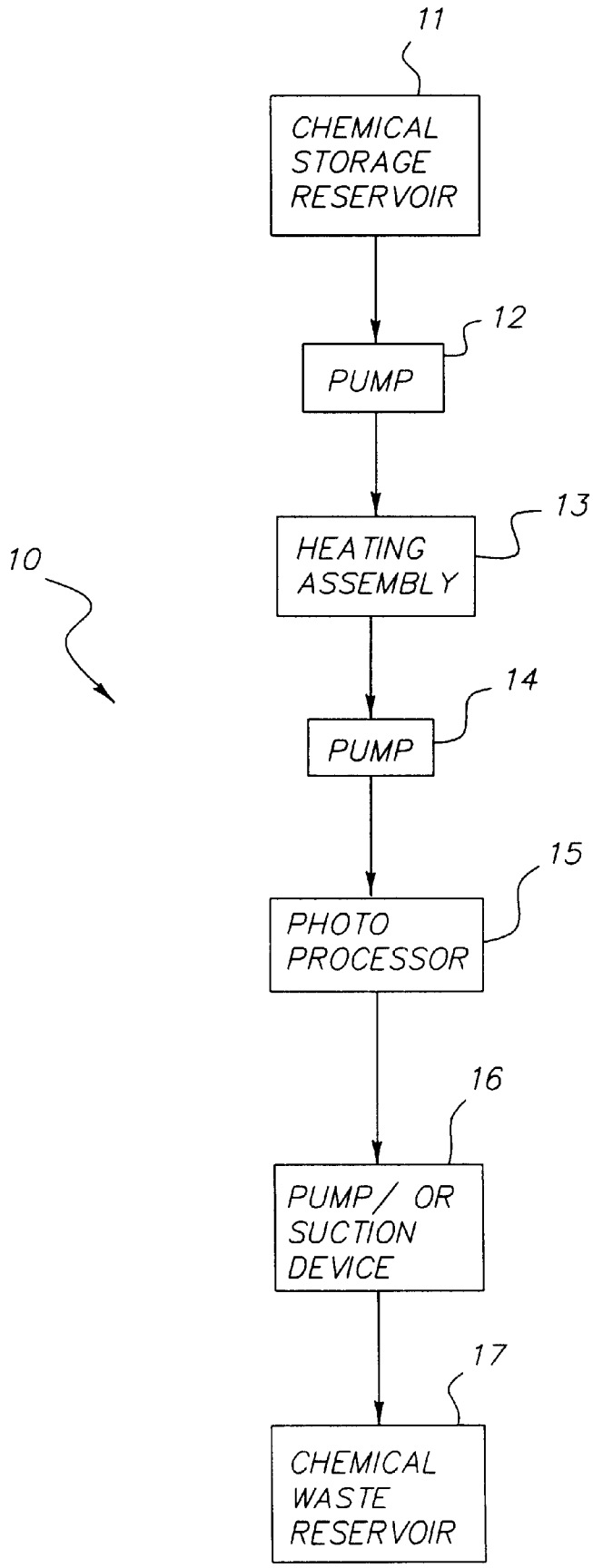
FIG. 1 is a schematic drawing of exemplary components in a chemical delivery system of the present invention.

As shown in FIG. 1, an exemplary chemical delivery system 10 of the present invention comprises a chemical storage reservoir 1, a heating assembly 13, and a chemical waste reservoir 17. The chemical delivery system 10 may also comprise one or more devices for moving a processing fluid from one location to another location within the photographic processor. As shown in FIG. 1, a pump 12 may be used to move processing fluid from chemical storage reservoir 11 to heating assembly 13. An optional pump 14 may be used to move heated fluid from heating assembly 13 to a photographic processor 15 such as a drum or tank. Further, a suction device or pump 16 may be used to remove processing fluid from processor 15 and transport the fluid to chemical waste reservoir 17.

It should be noted that other mechanisms may be used to move processing fluid from one location to another within the chemical delivery system of the present invention. For example, gravimetric force may be used to move processing fluid from heater assembly 13 to processor 15 and/or from processor 15 to chemical waste reservoir 17.

Each of the components of the chemical delivery system of the present invention is described in detail below.

The chemical storage reservoir may comprise four or more separate containers for storing multiple processing fluids. Typically, at least one storage container houses a developing solution, at least one storage container houses a bleach solution, at least one storage container houses a fix solution, and at least one storage container houses a wash solution. Regardless of whether the processing fluid is a developing, bleach, fix, or wash solution, the processing fluid is present within the storage container at a "working strength" concentration. As used herein, the phrase "working strength" is used to describe a processing fluid concentration, which may be used directly from the storage container without dilution with an external fluid, such as water.

Figure 2:
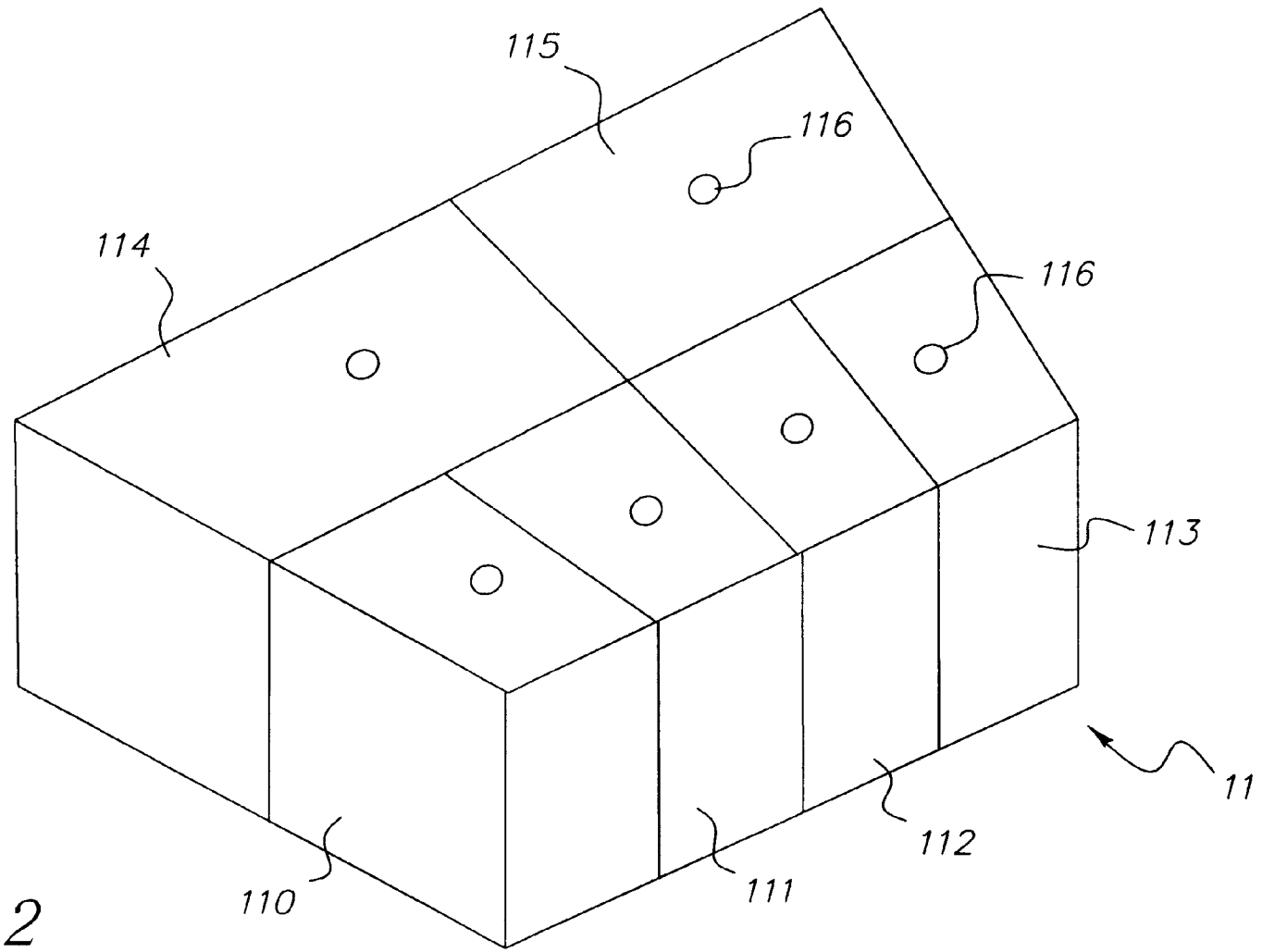
FIG. 2 depicts an exemplary chemical storage reservoir used in the chemical delivery system of the present invention.

An exemplary chemical storage reservoir, which may be used in the chemical delivery system of the present invention, is shown in FIG. 2. As shown in FIG. 2, chemical storage reservoir 11 comprises four chemical storage containers 110 through 113. Chemical storage reservoir 11 can further comprise two additional chemical storage containers 114 and 115 positioned behind or next to containers 110 to 113. Each container 110 through 115 has a container outlet 116 for introducing and/or removing chemicals from the container.

The size, shape configuration and number of containers within the chemical storage reservoir 11 may vary depending on a number of factors including, but not limited to, the desired capacity of the chemical delivery system, and the desired size of the photographic processor. Desirably, the chemical storage reservoir comprises at least four separate chemical storage containers housing a developing solution, a bleach solution, a fix solution, and a wash solution. During a given chemical processing method or a processing cycle, a desired volume of each solution (i.e., developing, bleach, fix and wash) is used to process photographic film.

As discussed above, the configuration of the four or more containers in the chemical storage reservoir may be any desirable configuration for a particular volume of space. For example, if the available volume of space is cylindrical, the four or more separate storage containers may have a pie shape, so that the total number of storage containers, when assembled, resembles a cylindrical volume of space.

Each storage container of the chemical storage reservoir may be connected to other components of the chemical delivery system, such as the heating assembly (described below). Processing fluids from the storage containers may be directed to other components of the chemical delivery system via conventional plastic tubing or any other means. In each fluid pathway from a storage container, a flow meter may be used to monitor and control the amount of processing fluid exiting each storage container. Further, a pump, or any other means of moving processing fluid, may be used in each fluid pathway to move processing fluid from a storage container to another location within the chemical delivery system. Desirably, each storage container has a separate fluid pathway and a separate pump, for moving each processing fluid to the other components of the chemical delivery system.

In a further embodiment of the present invention, the chemical storage reservoir rests on a sliding tray, which enables easy removal of the chemical storage reservoir from within a closed space, such as from within a photographic processor, to an open area, such as outside a photographic processor. Such an assembly allows for easy access and ease of maintenance during periodical replacement of one or more storage containers.

The chemical delivery system of the present invention may further comprise a heating assembly, which comprises one or more heating chambers for heating processing fluids prior to introduction into a photographic processor drum or tank. An exemplary heating assembly is shown in FIGS. 3–6.

Figure 3:
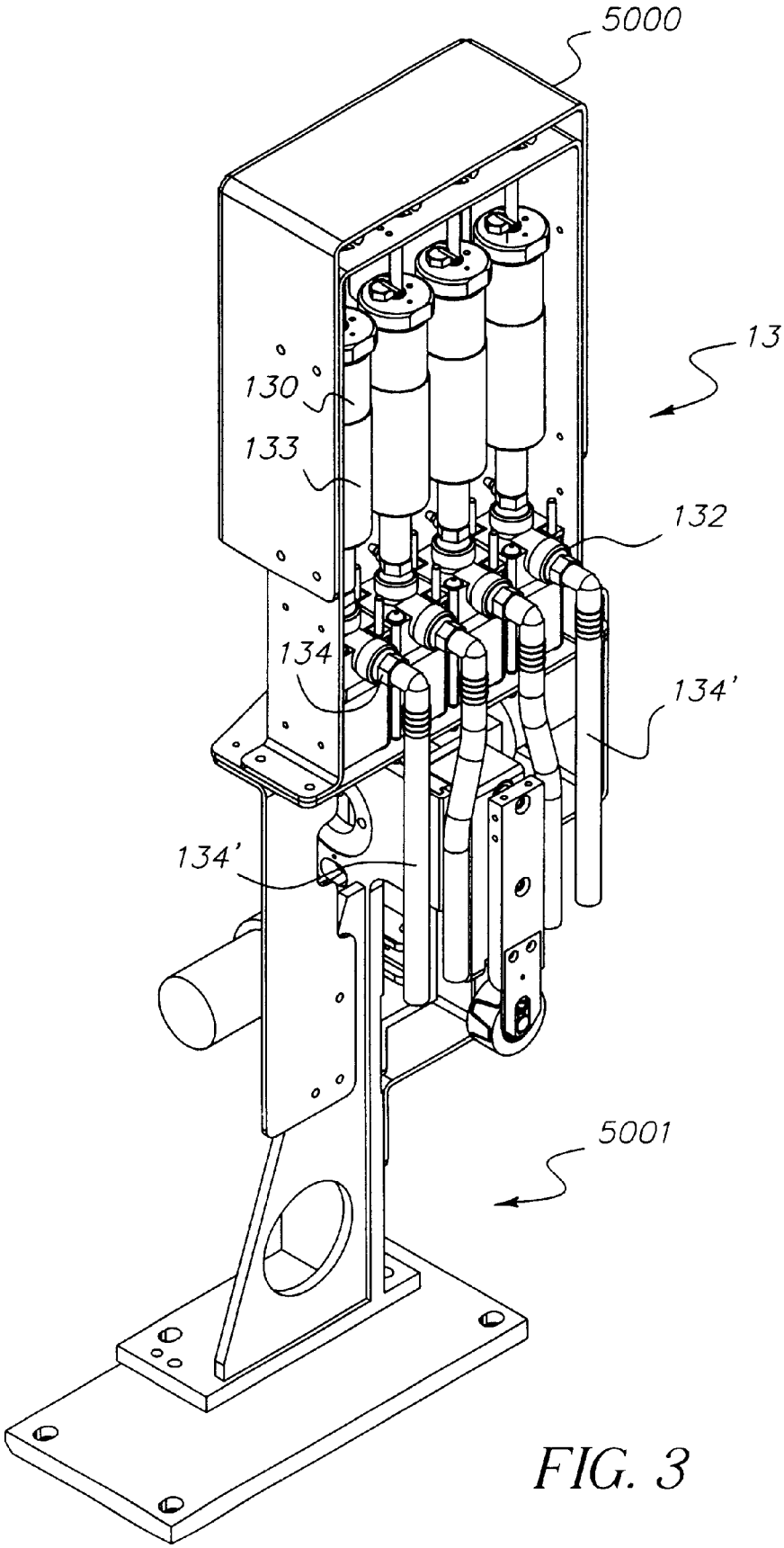
FIG. 3 is a rear view of an exemplary heating assembly for use in the chemical delivery system of the present invention.
Figure 4:
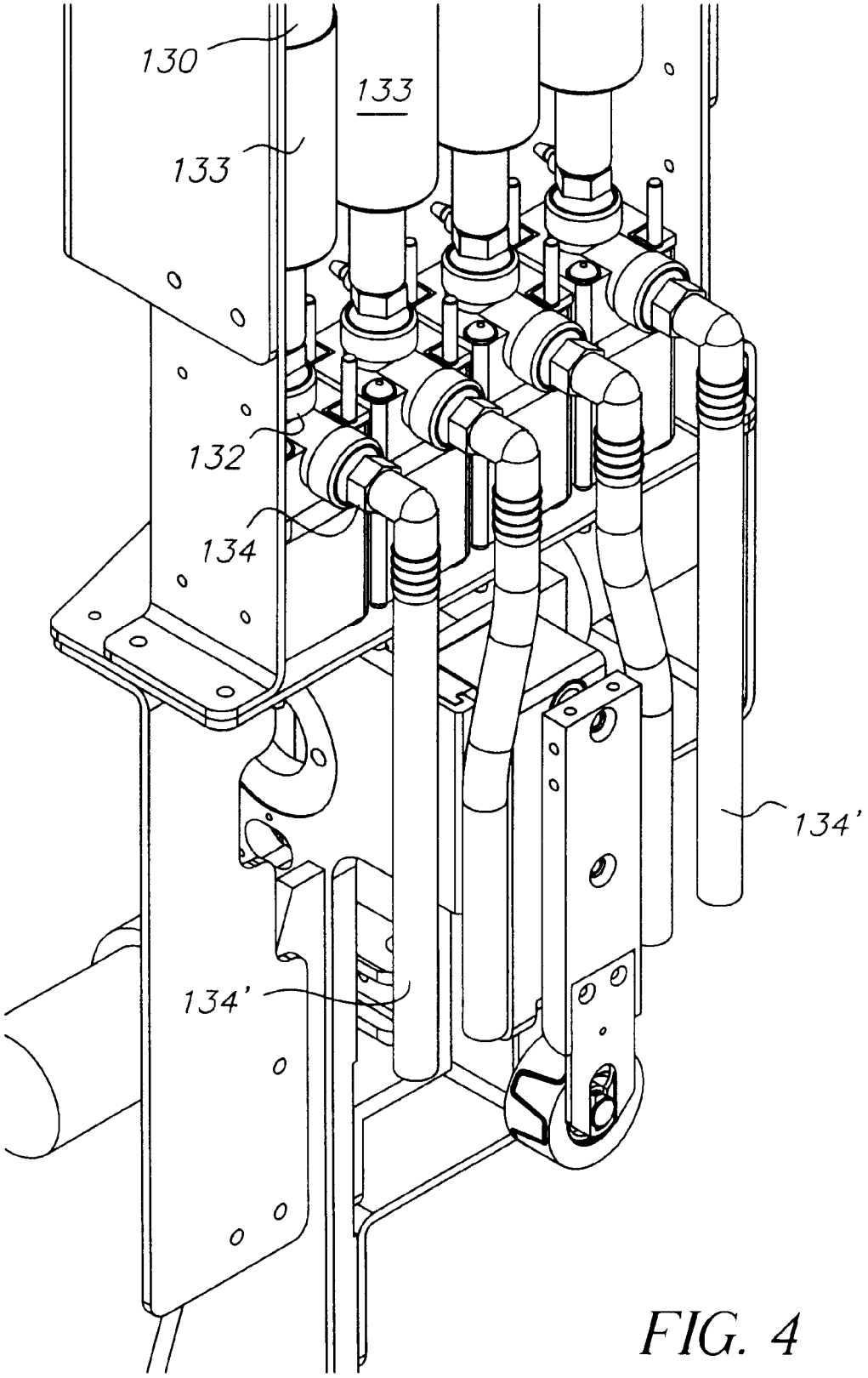
FIG. 4 is a frontal view of the exemplary heating assembly of FIG. 3.
Figure 5:
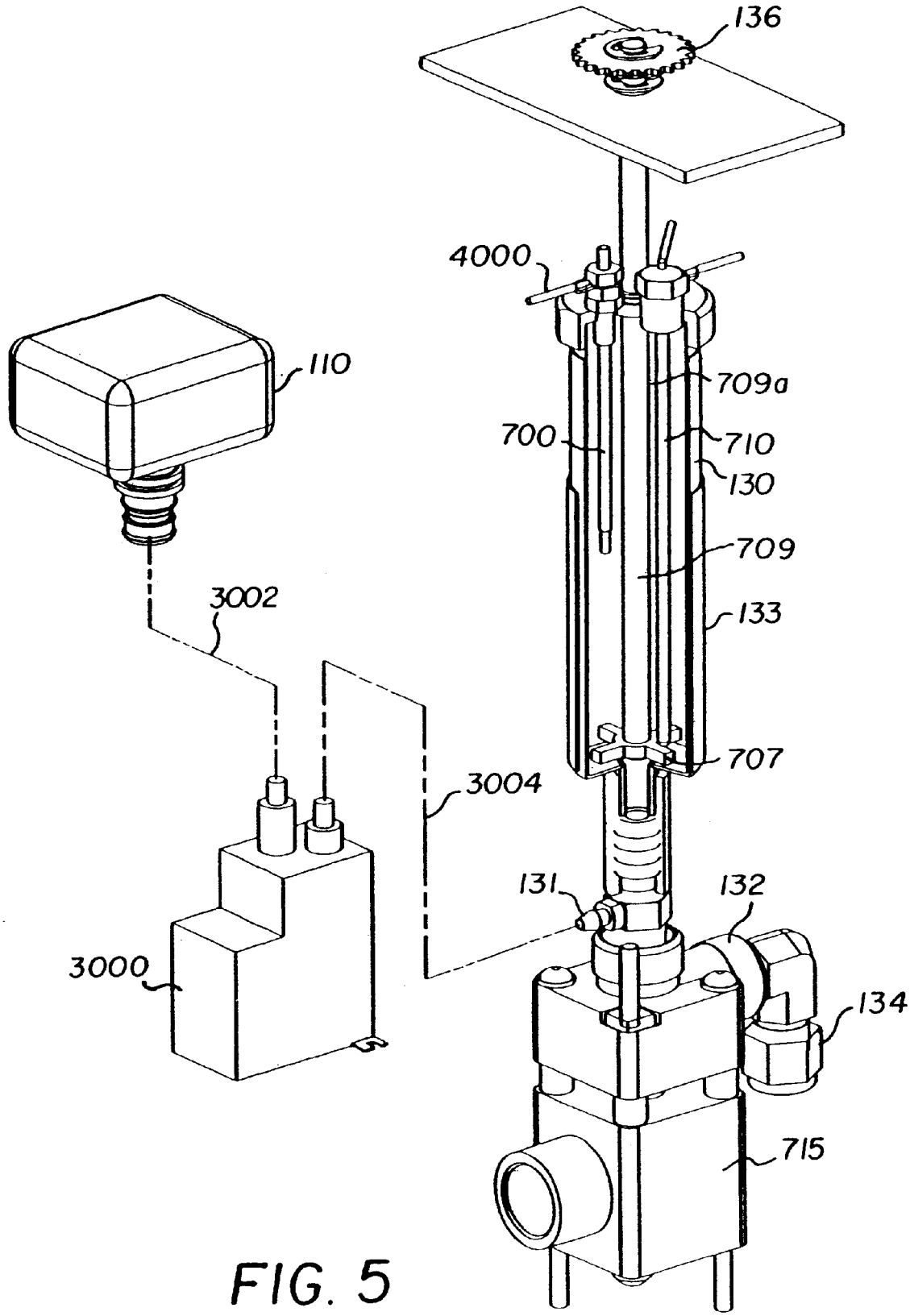
FIG. 5 shows a first embodiment of a heating chamber of the heating assembly in accordance with the present invention.

As shown in FIGS. 3 and 4, heating assembly 13 comprises four separate heating chambers in the form of stainless steel tubes (shown in FIG. 4 as 130). Heating assembly 13 including chambers 130 can be enclosed in a casing 5000 which can be mounted on a stand 5001 for placement at a location adjacent to or in the vicinity of a photographic processor. As shown in FIG. 5, which shows a single heating chamber of heating assembly 13, heating chamber 130 has a heating chamber inlet 131, which receives processing fluid from a chemical storage container (for example, container 110 in FIG. 2) of the chemical storage reservoir 11 described above. Heating chamber 130 is connected to an outlet chamber 132 which is in turn connected to a heating chamber outlet valve 134 and an outlet tube 134'. That is, as shown in FIGS. 3 and 4, each heating chamber 130 is connected to a heating chamber outlet valve 134 which lead to an outlet tube 134' for discharging heated fluid or solution from heating chamber 130 to a photographic processor. Each heating chamber 130 comprises a flexible heating tube or tape 133 positioned or wrapped around an outer surface of beating chamber 130 for heating the chamber 130 and its contents.

With reference to FIG. 5, which shows one of heating chambers 130 as an example, a pump 3000 is used to pump solution from container 110 to heating chamber inlet 131, via fluid lines 3002 and 3004. All of the heating chambers 130 include a level detection sensor 700 positioned within chamber 130. Level detection sensor 700 can be in the form of, for example, a metallic or stainless steel tube. The interior of all of the heating chambers 130 further include a stirrer 709 which includes a stirrer vanes 707. Additionally, positioned within each chamber 130 is a temperature sensor or monitor (thermister) 710 which monitors the temperature of the fluid within chamber 130.

Therefore, after processing fluid is pumped into heating chamber inlet 131 as described above, the fluid will enter into heating chamber 130 and rise within heating chamber 130. At this point, heating tube 133 can be activated to heat the processing fluid within heating chamber 130, and at the same time or shortly thereafter, stirrer 709 is rotated so as to mix the heated fluid within heating chamber 130.

In a feature of the present invention, only an appropriate or predetermined amount of processing fluid which is to be supplied to the associated processor is pumped into heating chamber 130. To achieve this feature, level detection sensors 700 in each of heating chambers 130 are positioned at an appropriate height for the specific processing fluid. For example, if more developing solution is required for a specific processing step than bleach solution, the level detection sensor 700 which is in the heating chamber 130 for the developing solution would be positioned at a higher level than the level detection sensor 700 that would be positioned in the heating chamber 130 for bleach solution.

Therefore, as processing solution or fluid fills heating chamber 130, heating chamber 130 is heated by the activation of heating tube 133, and at the same time, or shortly thereafter, the heated solution is stirred or mixed by way of stirrer 709. When the processing solution reaches a height as defined by level detection sensor 700, it is recognized that the appropriate amount of solution is now within heating chamber 130 for the specific processing to be performed. Essentially, the processing solution rising within heating chamber 130 contacts level detection sensor 700 which is connected to a central control circuit through a wire 4000 and thus completes a circuit. This would then provide a signal to a solenoid 715 also connected to the control circuit. At that point, solenoid 715 is activated so as to discharge the heated and stirred processing solution from heating chamber 130 via outlet chamber 132 and outlet valve 134. Solenoid 715 could be a two-way solenoid which has a first position that permits fluid to enter fluid inlet 131 and proceed into heating chamber 130, and a second position which closes inlet 131 while opening chamber 132 and chamber valve 134, so as to permit the supply of heated and mixed processing solution to an associated processor.

Thus, with the system of the present invention, only the actual or predetermined amount of solution that will be used at the specific processing stage is heated. This is due to the fact that the level detection sensor 700 which is set at a level based on the type of solution to be supplied to the processor, will signal when enough solution is within chamber 130. At that point, solenoid 715 opens chamber 132 and chamber valve 134 to deliver the heated and stirred solution to the associated processor. With the arrangement of the present invention, there is no need to heat a large amount of solution stored within, for example, a large storage container.

Chamber 130 further includes a temperature monitor or sensor 710 which monitors and controls the temperature of solution within heating chamber 130. Therefore, the system could be designed to shut down if the temperature of the solution becomes too high. Further, temperature monitor 710 monitors and controls the heating of the processing solution so as to assure that the processing solution is delivered to the processor at the appropriate temperature.

Figure 6:
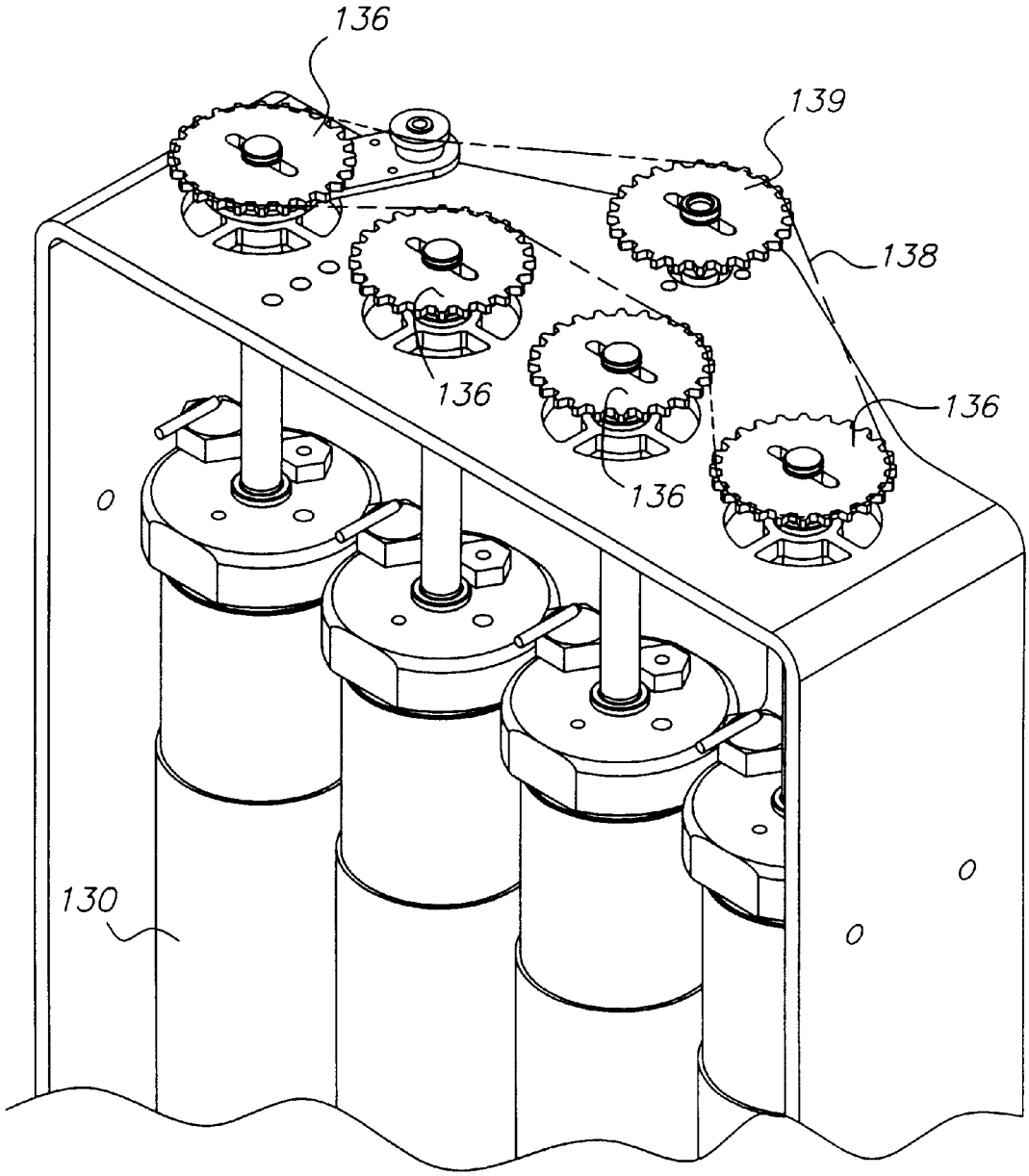
FIG. 6 displays a close-up view of an exemplary driving device for a stirring assembly used in the chemical delivery system of the present invention.

As shown in FIG. 5, stirring mechanism 709 of the present invention comprises a rod 709*a* which extends above heating chamber 130. The rod is connected to a sprocket 136 which when rotated, rotates stirring vanes 707. In the arrangement of the present invention in which, for example, four heating chambers are utilized as shown in FIG. 4, sprockets 136 could be set up as shown in FIG. 6. More specifically, FIG. 6 is a top view of a heating assembly which includes four heating chambers 130. As shown in FIG. 6, stirring mechanism 709 may comprise multiple sprockets 136; multiple stirring rods 709*a*, (a portion which extends into beating chambers 130); a chain 138 which connects the sprockets 136 to one another, and a drive sprocket 139 which is driven by a motor not shown.

Heating tube 133 of heating chamber 130 is preferably heated using electricity, steam or any other conventional method of providing heat. Using temperature monitor 710 and level detecting sensor 700 it can be determined that the desired amount of processing fluid is in chamber 130, and the processing fluid has reached the desired temperature. Thereafter, solenoid 715 can be actuated to open chamber 132 and chamber valve 134 and thus permit the heated and mixed processing fluid to exit from heating chamber 130.

The number of heating chambers 130 in heating assembly 13 may vary depending on a number of factors including, but not limited to, the preferred processing cycle, the desired chemical processing time for processing a roll of film, the desire to heat one or more processing fluids simultaneously, and the available space for the heating assembly. Desirably, heating assembly 13 comprises at least four separate heating chambers 130 so that each processing fluid may be heated simultaneously, sequentially or in an overlapping manner.

Each heating chamber 130 may be heated independently from one another, or may be heated and controlled simultaneously with other heating chambers 130. Desirably, each heating chamber is capable of accelerated heating of a given volume of processing fluid up to a known or acceptable temperature or temperatures which are appropriate to achieve the desired processing result. Heating rates and final temperatures may be controlled by a microprocessor or computer, wherein heating rates and final temperatures are programmed into the microprocessor or inputted by an operator for a particular type of film.

Each heating chamber of the heating assembly may feed into another component, such as a photographic processor tank or drum. Heated processing fluids from the heating assembly may be directed to other components of the chemical delivery system via conventional plastic tubing or any other means as described above. The fluid pathway from the heating chamber(s) may converge into a single pathway of tubing prior to reaching another component, such as a photographic processor, or may remain as separate fluid pathways to the other component. In each fluid pathway, a flow meter may be used to monitor and control the amount of heated processing fluid exiting each heating chamber. Desirably, each heating chamber has a separate fluid pathway, and optional flow meters and pumps for each fluid pathway to the other components of the chemical delivery system.

The chemical delivery system of the present invention may also comprise a chemical waste reservoir for collecting processing fluids after the fluid has gone through a processing cycle in an associated process. The chemical waste reservoir may have any size and shape, which is compatible with a given chemical delivery system and photographic processor. Desirably, the volume capacity of the chemical waste reservoir is substantially equal to or greater than the total volume capacity of the chemical storage reservoir.

The chemical delivery system of the present invention may be used in a variety of processing equipment, but has particular utility in a photographic processor. The chemical delivery system of the present invention may be used in a photographic processor capable of processing one or more types of film including, but are not limited to, APS film, 135 mm film. Desirably, the chemical delivery system of the present invention is used in combination with a photographic processor designed to process APS film, 135 mm film, or both APS and 135 mm film. One particularly desirable photographic processor for use with the chemical delivery system of the present invention is a circular drum processor as disclosed in copending U.S. patent application Ser. No. 10/027,382 filed Dec. 21, 2001, entitled "PHOTOGRAPHIC PROCESSOR AND METHOD OF OPERATION".

The present invention is further directed to a process of delivering processing chemicals to a photographic processor tank or drum using the above-described chemical delivery system. In one embodiment of the present invention, the process comprises (a) transferring one or more processing fluids from a chemical storage reservoir comprising one or more chemical storage containers to a heating assembly comprising one or more heating chambers; (b) heating the one or more processing fluids to a first temperature in the one or more heating chambers; (c) transferring a first heated processing fluid from the one or more heating chambers to a photographic processor, and (d) transferring the first heated processing fluid from the photographic processor reactor to a chemical waste reservoir.

The process of the present invention may be used to deliver one or more processing fluids, such as solutions used in a photographic processor (i.e., developing, bleach, fix, and wash solutions), as well as other types of solutions in processing equipment.

The process of the present invention is capable of heating one or more processing fluids simultaneously or sequentially in an accelerated manner.

Figure 7:
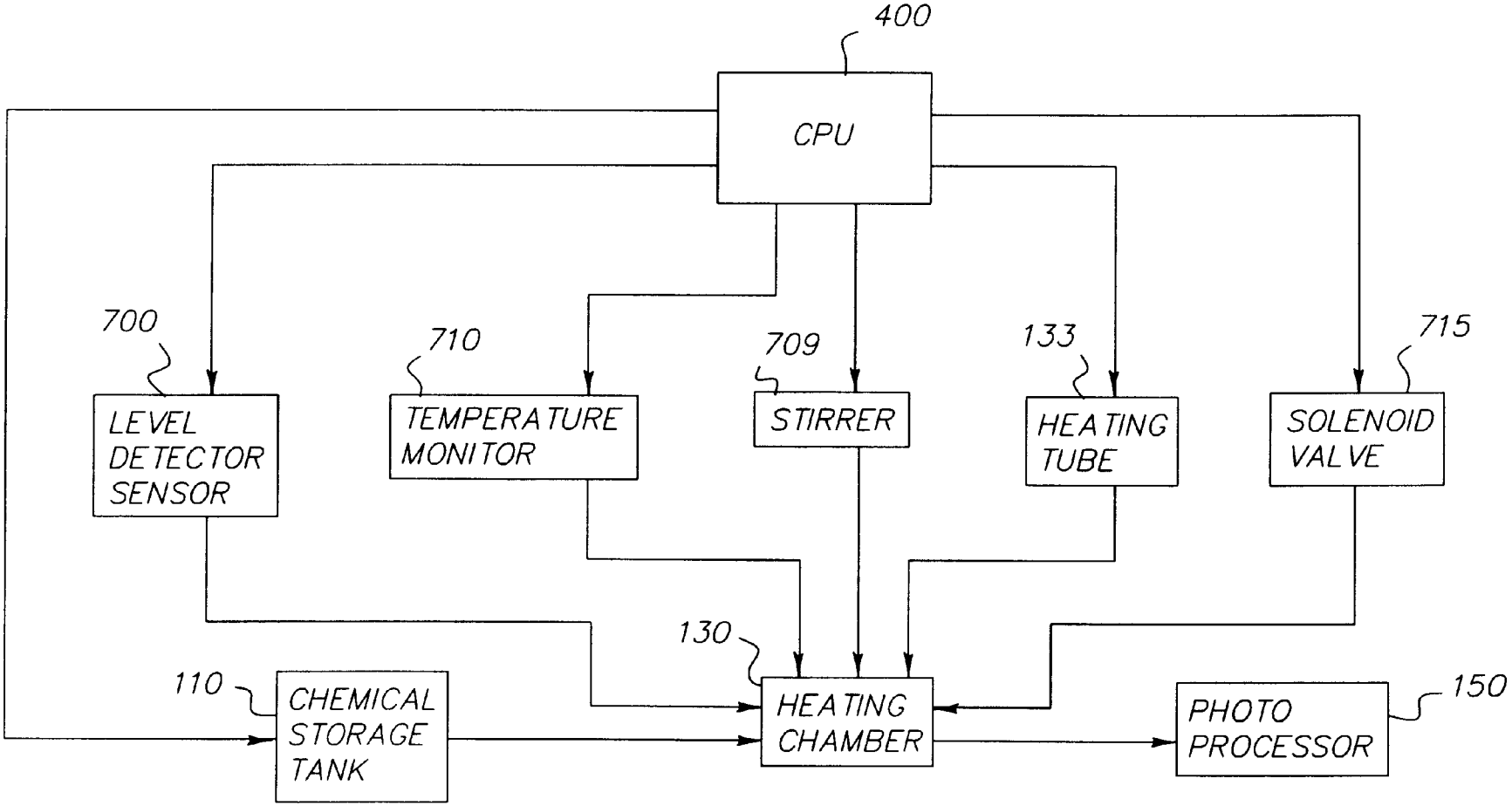
FIG. 7 is a schematic representation of a control arrangement for the chemical delivery system of the present invention.

The process of the present invention with respect to supplying processing solution to the heating chamber and supplying the heated processing solution to a processor could be performed manually, in an automated process controlled by a central processing unit or a combination of the two. FIG. 7 is a schematic illustration showing an example process for controlling the supply of processing solution to a processor. As illustrated in FIG. 7, a computer or control processor (CPU 400) can be used to control a portion or all of the process. In the example of FIG. 7, a single storage tank 110 is shown, however, it is recognized that in the process of the present invention, a different storage tank for each chemical or processing solution could be used. CPU 400 provides a signal to storage tank 110 indicating that a first amount of processing solution is to be supplied to heating chamber 130. As the processing solution is supplied to heating chamber 130, level detection sensor 700 which is operationally associated with CPU 400, detects when the processing solution reaches a predetermined height (volume) and, therefore, would signal that a predetermined volume or the first amount of processing solution which is to be supplied at the specific step of the process is in chamber 130. Further, heating tube 133 also associated with CPU 400, receives instructions to heat the processing solution in the chamber 130, either after chamber 130 is filled, or as chamber 130 is filling. Additionally, solenoid 715 also operationally associated with CPU 400 is in a first position where processing solution is permitted to enter heating chamber 130 and prevented from exiting heating chamber 130. Temperature monitor 710 operationally associated with CPU 400 monitors the temperature of the processing solution that is heated within heating chamber 130 to assure that the processing solution reaches the proper temperature, and also, to prevent the processing solution from being overheated. In the event that the processing solution is overheated, temperature monitor 710 can provide a signal to CPU 400 to shut down the process. Stirrer 709 also receives a signal from CPU 400 to actuate the stirrer, so as to mix the processing solution while it is being heated or after it is heated, and prior to the solution being delivered to an associated processor 150.

After the processing solution reaches the predetermined level as confirmed by level detection sensor 700, and after the desired temperature is reached as confirmed by temperature monitor 710, CPU 400 controls solenoid 715 to open chamber 132 and chamber valve 134, and permit the delivery of the heated and stirred processing solution to processor 150. Thereafter, CPU 400 can control the process described above for the supply of the next processing solution from a further storage container or, can provide for a washing cycle if necessary.

In photoprocessors such as the circular drum processor disclosed in copending U.S. patent application Ser. No. 10/027,382 filed Dec. 21, 2001, entitled "PHOTOGRAPHIC PROCESSOR AND METHOD OF OPERATION", there is a short process time. In these types of processors, it is advantageous that no residual chemicals be left on the delivery tubes which deliver processing solution from chemical storage tanks to the processor. In the chemical delivery system of the embodiment illustrated in FIG. 4, processing solution is led through separate outlet tubes 134' to the photographic processor. Therefore, separate tubes 134' are preferably cleaned on an individual basis.

Figure 8:
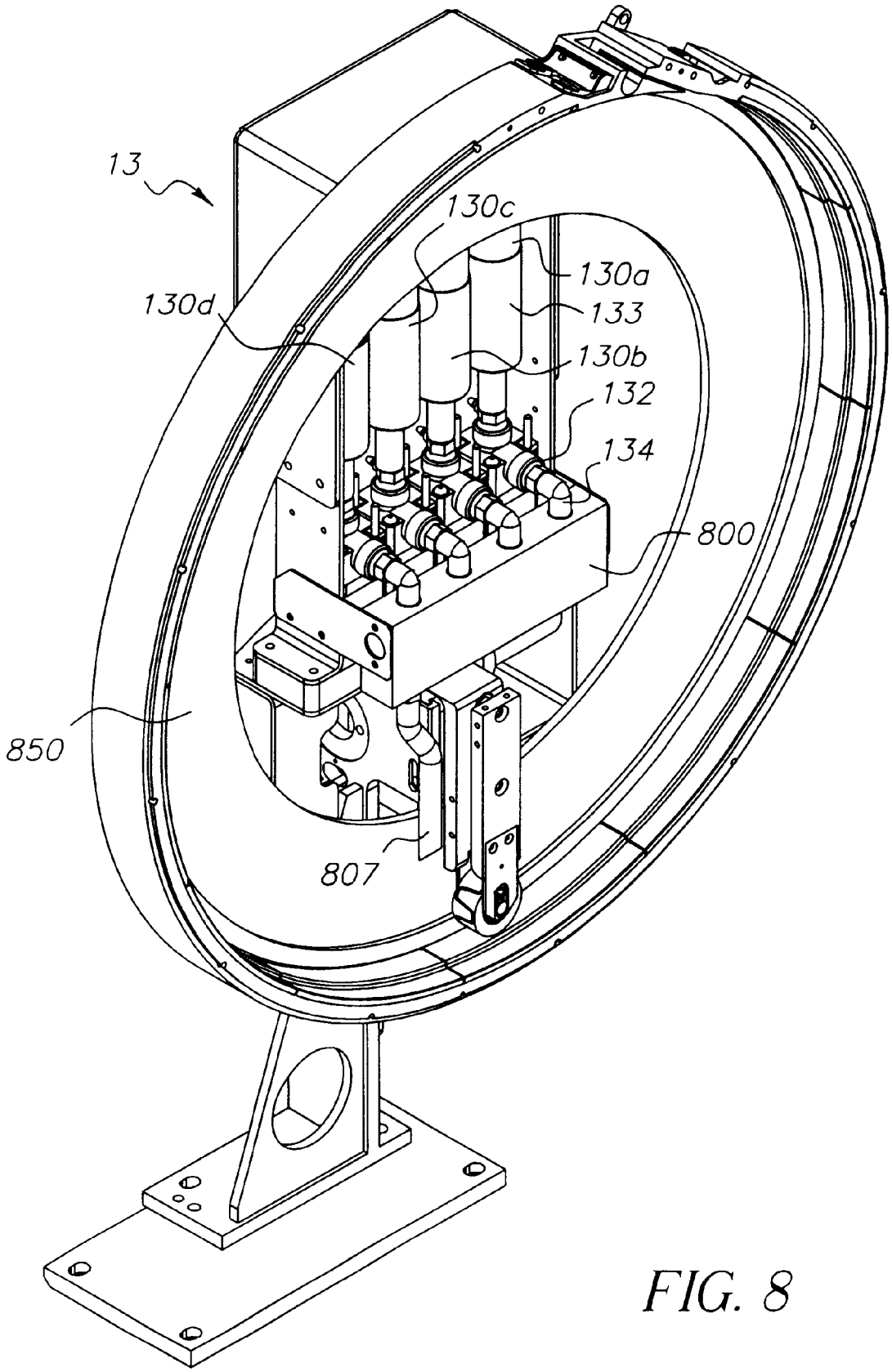
FIG. 8 is a schematic view of a further embodiment of the chemical or processing solution delivery system of the present invention in association with a processor.
Figure 9:
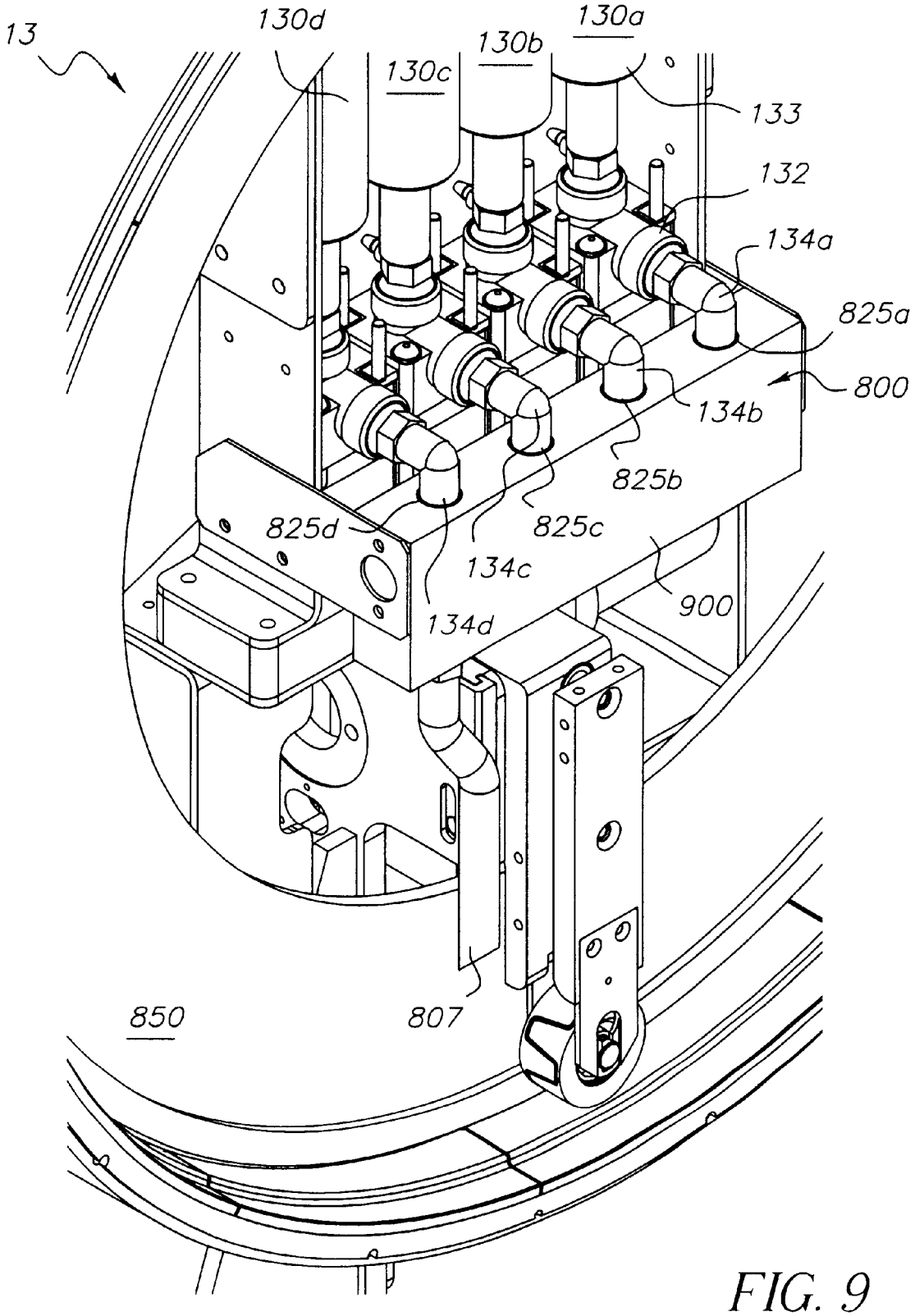
FIG. 9 is a view of the chemical or processing solution delivery system of FIG. 8.
Figure 10:
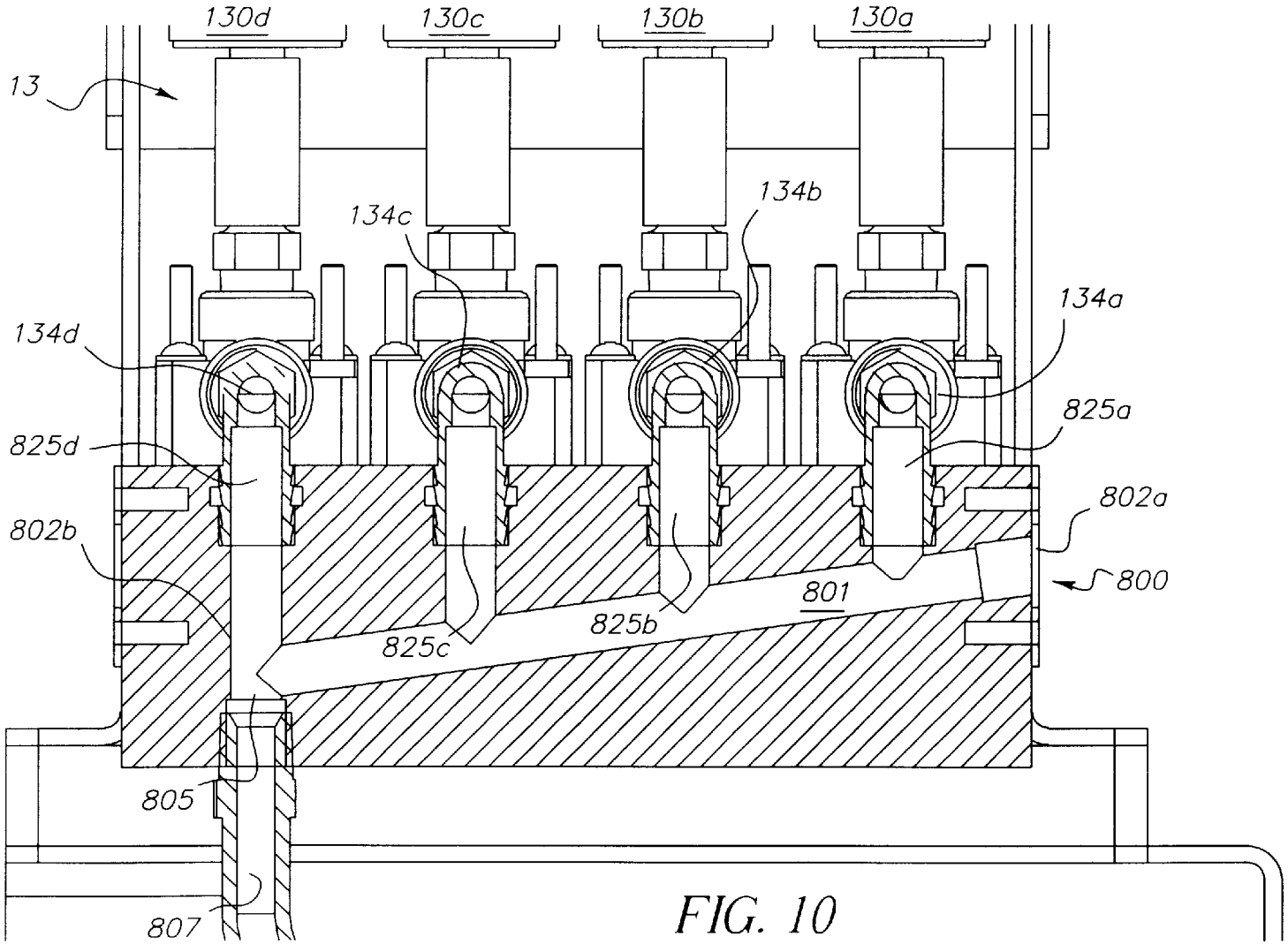
FIG. 10 is a detailed view of a manifold of the chemical delivery system of FIGS. 8 and 9 in accordance with the present invention.

FIGS. 8–10 illustrate a further embodiment of the system of the present invention which facilitates cleaning. FIGS. 8–10 show a manifold which is provided intermediate to the processing solution chambers and processor in accordance with the present invention. The manifold as illustrated in FIGS. 8–10 is designed such that all the processing solution comes through the manifold, with the last processing solution being a wash solution, which cleans the manifold totally, to prevent any chance of contamination.

FIG. 8 illustrates assembly 13 as previously described, associated with a drum processor as disclosed in, for example, copending U.S. patent application Ser. No. 10/027,382 filed Dec. 21, 2001, entitled "PHOTOGRAPHIC PROCESSOR AND METHOD OF OPERATION". As shown in FIG. 8, each of outlets 134 leads to a manifold 800, with the outlet of manifold 800 leading to a supply tube 807. Tube 807 leads processing solution to a processor, such as a drum processor 850 shown in FIG. 8. In FIG. 8, only one-half of drum processor 850 is shown to facilitate understanding of the invention.

FIG. 9 is a more detailed view of assembly 13, in which outlets 134 are respectively identified as outlets 134*a*, 134*b*, 134*c* and 134*d* so as to correspond with the four chambers 130*a*–130*d* shown in FIGS. 8 and 9. As illustrated in FIG. 9, manifold 800 includes openings 825*a*, 825*b*, 825*c*, 825*d* which correspond to each of the outlets 134*a*–134*d*.

A more detailed view of manifold 800 is shown in FIG. 10. As illustrated in FIG. 10, manifold 800 includes an inclined or slanted path 801 which inclines or slants in a downward direction and in a solution flow direction, from a closed upper end 802*a* to a lower end 802*b* having an outlet. More specifically, end 802*a* of inclined path 801 does not include an outlet so that processing solution which enters processing path 801 via inlet or manifold bore 825*a* will travel by way of inclined path 801 to lower end 802*b* of manifold 800. At lower end 802*b*, an outlet 805 is provided for leading solution from inclined path 801 to supply tube 807. Supply tube 807 supplies processing solution to an associated processor such as processor 850 shown in FIG. 8.

A typical processing cycle involves the application of developer solution, bleach solution, fix solution and wash solution. In a preferred feature of the present invention, wash solution is supplied via manifold bore or inlet 825*a* located at an upper most point of inclined processing path 801 with respect to the remaining bores or inlets. More specifically, each of manifold bores 825*a*–825*d*, are spaced along inclined processing path 801 so as to supply solution to different points along inclined processing path 801. In a preferred feature of the present invention, wash solution is supplied from chamber 130*a* to inclined path 801 via bore or inlet 825*a*, developing solution is supplied from chamber 130*b* to inclined path 801 via bore 825*b*; one of a fixed solution or a bleach solution is supplied from chamber 130*c* to inclined path 801 via bore 825*c*; and the other of the bleach or fix solution is supplied from chamber 130*d* to inclined path 801 via bore 825*d*. Thus, in an embodiment of the present invention, beginning from inlet or bore 825*a* furthest from outlet 805, the supplied solutions are preferably wash solution via bore 825*a*; developer solution via bore 825*b*; one of a bleach or fix solution via bore 825*c*; and the other of the bleach or fix solution via bore 825*d*. Each of the bores 825*a*–825*d* extend from an upper part or end of inclined path 801 to a lower part or end of inclined path 801. In some processes or processing cycles where the bleach follows the developer, a preferred supply arrangement would be the introduction of wash solution via port 825*a*, and in descending order, developer, fix and bleach through bores 825*b*, 825*c*, 825*d*.

A method of operation of the present invention with respect to processing photographic material will now be described. During a processing cycle of photographic material, processing solutions such as developer solution, fix solution, bleach solution and wash solution are supplied to a processor to develop the photographic material. In a typical processing cycle, developer solution is first applied. That is, developer solution held in chamber 130*b* is supplied via outlet 134*b* and bore 825*b* into inclined path 801. It is noted that bore 825*b* for introducing developer solution into inclined path 801 is located immediately downstream of bore 825*a* for wash solution. Developer solution which enters inclined path 801 via bore 825*b* is led by way of inclined path 801 to lower end 802*b* of inclined path 801, and exits manifold 800 via outlet 805 located at the lower end of inclined path 801 to supply tube 807. Supply tube 807 supplies the developer solution to an associated processor for processing of the photograph material. After the supply of developer solution, at least one of a fix or bleach solution held in chamber 130*c* is supplied. That is, one of a fix or bleach solution held in chamber 130*c* is supplied via outlet 134*c* and bore 825*c* into inclined path 801. Bore 825*c* is located immediately downstream of bore 825*b* with respect to a direction of solution flow. After introduction into inclined path 801, the one of the fix or bleach solution travels along inclined path 801 and exits via outlet 805 to supply tube 807 for delivery to the processor. After this, the other of the fix or bleach solution held in chamber 130*d* is supplied to inclined path 801 via outlet 134*d* and bore 825*d*. It is noted that bore 825*d* is substantially aligned with outlet 805 and that bore 825*d* is located at the lower-most end of inclined path 801 with respect to the other bores 825*c*, 825*b*, 825*a*. The other of the bleach or fix solution is appropriately thereafter supplied via supply tube 807 to the processor.

Thereafter, wash solution held in chamber 130*a* is supplied to inclined path 801 via outlet 134*a* and bore 825*a*. Bore 825*a* is located at closed end 802*a* and more specifically, at the uppermost end of inclined path 801 with respect to the other bores 825*b*, 825*c*, 825*d*. Thus, wash solution supplied via bore 825*a* travels along substantially the entire length of inclined processing path 801, and passes by all of the bores 825*b*, 825*c* and 825*d*. Wash solution thereafter is led through outlet 805 to supply tube 807 for application to the processor.

This specific arrangement ensures that the wash solution completely cleans or removes residue from substantially the entire inclined path 801, and it is noted that the wash solution passes by the openings of bores 825*b*, 825*c* and 825*d*. Wash solution further passes through supply tube 807 into the processor to both clean supply tube 807 and components of the processor. Since the wash solution is the last solution in the processing cycle, it is assured that all of the necessary components are cleaned of the previously supplied solution such as developer, fix, and bleach solutions, before the next processing cycle begins.

In a feature of the invention, it is noted that the wash solution basically defines the longest flow path to the processor. This assures that all points between the introduction of wash solution to inclined path 801 and the processor is appropriately cleaned and removed of residue. The developer solution has a flow path to the processor which is shorter than the flow path of the wash solution, while one of the fix or bleach solution (in chamber 130*c*) has a flow path shorter than the developer solution flow path, and the other of the fix or bleach solution (in chamber 130*d*) has a flow path which is shorter than the flow path of the one of the fix or bleach solution.

In the design of the present invention, the pitch of inclined path 801 is angled so that the solutions run down the manifold to outlet 805. It is noted that contamination of developer solution by either fix solution or bleach solution can effectively alter the performance of the developer solution. The arrangement of the present invention overcomes this by providing for the introduction of the developer solution upstream of the introduction of the fix or bleach solution. More specifically, developer solution is introduced via bore 825*b* which is located upstream of bores 825*c* and 825*d* which introduce fix or bleach solution. With the arrangement of the present invention, the introduction of developer is always at a position that is higher along the pitch of the inclined path 801 than either the fix or the bleach solution. Further, the wash solution is always at the highest pitch of inclined path 801 to ensure that all potential contaminants in the manifold are removed so that the next order to be processed begins with a clean delivery of developer solution.

The solution at a lower point of the pitch of inclined path 801 and therefore, the solution closer to outlet 805 is preferably the solution that immediately follows the developer. The development step in photographic processes is a kinetically controlled processing step that provides image discrimination based on silver halide exposure. The development reaction therefore should not run to completion. Stopping the development reaction at an appropriate time in the development step provides for improved image rendition. Therefore, halting development is a function of the solution that follows the developer. This solution should be added quickly in order to effectively and uniformly quench the development reaction. In the method and system of the present invention, this is achieved by providing for the introduction of a fix or bleach solution into inclined path 801 downstream of the developer solution. This provides for a shorter processing path to the processor for halting development. As shown in FIG. 10, in some instances, one of the fix or bleach solution is supplied from chamber 130*d* to inclined path 801 via bore 825*d*. This assures the shortest route between chamber 130*d* and the processor, to quickly and effectively stop the development reaction. In some type of processes, the solution necessary to quickly halt the development reaction is a fix solution, and thus, the fix solution is supplied at the lowest point and more specifically, via bore 825*d* to the processor. For other types of processing cycles, the bleach solution is necessary to halt the development process and thus, bleach is applied via bore 825*d*.

Therefore, the present invention provides for a processing solution delivery system and method which can sequentially provide processing solution to a processor in manner in which the contamination of the solutions is prevented.

In a further feature of the invention, manifold 800 could include a heating member 900 or a conductive member adapted to be heated. As an example, heating member 900 could be a conductive strip or tape attached to a wall of manifold 800 as shown in FIG. 9. Heating member 900 could be used to help elevate or maintain the processing solution traveling through manifold 800 at a temperature appropriate for processing of photographic material in the associated processor. As indicated above, heating member 900 is preferably in the form of a conductive strip or tape with an electrical source being associated with the conductive strip or tape to heat the conductive strip or tape. Of course, the present invention is not limited to a conductive strip or tape and it is recognized that other sources of heat such as radiant heat, heated air flow, etc. can be used to elevate or maintain the temperature of the manifold and the processing solution at a temperature which is appropriate for processing.

The invention has been described in detail with particular reference to certain preferred embodiments thereof, but it will be understood that variations and modifications can be effected within the spirit and scope of the invention.

What is claimed is:

1. A chemical delivery system for a photographic processor, the chemical delivery system comprising:

a plurality of chambers, each of said chambers being adapted to hold a distinct processing solution therein;

a manifold fluidly connected to said plurality of chambers, said manifold having an inclined solution passageway and a plurality of manifold bores spaced along the inclined solution passageway, each of said manifold bores extending from a chamber outlet of a respective chamber to said inclined solution passageway, said inclined solution passageway having a closed end at an upper part of the inclined solution passageway and a manifold outlet at a lower part of the inclined solution passageway, such that solution flows in a direction from the upper part to the lower part of the inclined solution passageway, wherein a first one of said plurality of chambers is adapted to hold a wash solution and deliver the wash solution to a first manifold bore of said plurality of manifold bores that is located at the upper part of the inclined passageway, so that the wash solution flows along substantially an entire length of the inclined passageway from the upper part to the manifold outlet; and a supply tube fluidly connected to said inclined solution passageway and located at the manifold outlet of the inclined solution passageway to lead processing solution to an associated processor.

2. A chemical delivery system according to claim 1, wherein a second one of said chambers is adapted to hold a bleach solution, a third one of said chambers is adapted to hold a fix solution, and a fourth one of said chambers is adapted to hold a developer solution, the fourth one of said chambers adapted to hold the developer solution is further adapted to deliver the developer solution to a second manifold bore of said plurality of manifold bores which is located downstream, with respect to the solution flow direction, of the first manifold bore.

3. A chemical delivery system according to claim 2, wherein both the second one of said chambers adapted to hold a bleach solution and the third one of said chambers adapted to hold a fix solution are further adapted to respectively deliver bleach solution and fix solution to a third manifold bore and a fourth manifold bore of said plurality of manifold bores, said third and fourth manifold bores being located downstream, with respect to the solution flow direction, of the second manifold bore.

4. A chemical delivery system according to claim 1, further comprising a heating member provided on a wall of the manifold, said heating member being adapted to elevate a temperature of the processing solution to an appropriate temperature for processing.

5. A processing solution delivery system for a photographic processor, the processing solution delivery system comprising:

a first solution flow path having a first length, said first solution flow path extending from a first chamber adapted to hold washing solution therein to a processor, a second solution flow path having a second length shorter than said first length, said second solution flow path extending from a second chamber adapted to hold a developer solution therein to said processor;

a third solution flow path having a third length shorter than said second length, said third solution flow path extending from a third chamber adapted to hold one of a fix solution or a bleach solution therein to said processor, and a fourth solution flow path having a fourth length shorter than said third length, said fourth solution flow path extending from a fourth chamber adapted to hold the other of the fix solution or the bleach solution therein to said processor.

6. A processing solution delivery system according to claim 5, wherein said first solution flow path includes an inclined path having an upper end and a lower end, a solution outlet being located at said lower end, said wash solution traveling from a first point of said inclined path adjacent to said upper end to the solution outlet at said lower end of the inclined path.

7. A processing solution delivery system according to claim 6, wherein said second flow path includes a first portion of said inclined path which extends from a second point of said inclined path downstream from said first point to said lower end of said inclined path, said developer solution traveling from said second point of said inclined path to the solution outlet at said lower end of said inclined path.

8. A processing solution delivery system according to claim 7, wherein said third solution flow path includes a second portion of said inclined path which extends from a third point of said inclined path downstream from said second point to said lower end of said inclined path, said one of said fix solution or said bleach solution traveling from said third point of said inclined path to the solution outlet at said lower end of said inclined path.

9. A processing solution delivery system according to claim 8, wherein said fourth solution flow path includes a third portion of said inclined path located at said lower end of said inclined path and downstream from said third point, said third portion of said inclined path being aligned with said solution outlet at the lower end of said inclined path, such that the other of said fix solution or said bleach solution travels from said third portion to said solution outlet.

10. A processing solution delivery system according to claim 9, wherein each of said first solution flow path, said second solution flow path, said third solution flow path, and said fourth solution flow path further include a common supply tube which leads from the solution outlet of said inclined path to the processor.

11. A processing solution delivery system for a photographic processor, the processing solution delivery system comprising:

a plurality of chambers, each of said chambers holding a distinct processing solution therein; and a manifold which provides a fluid connection between each of said plurality of chambers and an associated processor for delivering processing solution to the associated processor, said manifold comprising an inclined path which includes an upper end and a lower end;

wherein each of said plurality of chambers is adapted to deliver processing solution to different points along said inclined path of said manifold.

12. A processing solution delivery system according to claim 11, wherein a first one of said distinct processing solutions is a wash solution, said wash solution being held in first chamber of said plurality of chambers which is adapted to deliver the wash solution to said inclined path at a first point along said inclined path which is adjacent to the upper end, said wash solution flowing in a direction from the upper end to the lower end of the inclined processing path.

13. A processing solution delivery system according to claim 12, wherein a second one of said distinct processing solutions is a developer solution, said developer solution being held in a second one of said plurality of chambers which is adapted to deliver the developer solution to said inclined path at a second point along said inclined path which is downstream from said first point, said developer solution flowing from said second point to the lower end of said inclined path.

14. A processing solution delivery system according to claim 13, wherein a third one of said distinct processing solutions is one of a fix solution or a bleach solution, said one of said fix solution or said bleach solution being held in a third one of said plurality of chambers which is adapted to deliver said one of said fix solution or said bleach solution to said inclined path at a third point along said inclined path which is downstream from said second point, said one of said fix solution or said bleach solution flowing from said third point to the lower end of said inclined path.

15. A processing solution delivery system according to claim 14, wherein a fourth one of said distinct processing solutions is the other one of said fix solution or said bleach solution, said other one of said fix solution or said bleach solution being held in a fourth one of said plurality of chambers which is adapted to deliver said other one of said fix solution or said bleach solution to said inclined path at a fourth point along the inclined path which is downstream from said third point, said other one of said fix solution or said bleach solution flowing from said third point to the lower end of said inclined path.

16. A processing solution delivery system according to claim 15, further comprising a supply tube which extends from said lower end of said inclined path to the processor.

17. A photofinishing arrangement comprising:

a processor adapted to process photographic film; and a processing solution delivery system adapted to deliver processing solution to said processor;

said processing solution delivery system comprising:

a plurality of chambers, each of said chambers being adapted to hold a distinct processing solution therein;

a manifold fluidly connected to said plurality of chambers, said manifold having an inclined solution passageway and a plurality of manifold bores spaced along the inclined solution passageway, each of said manifold bores extending from an outlet of a respective chamber to said inclined solution passageway, said inclined solution passageway having a closed end at an upper part of the inclined passageway and an opening at a lower part of the inclined passageway, such that solution flows in a direction from the upper part to the lower part of the inclined passageway, wherein a first one of said plurality of chambers is adapted to hold a wash solution and deliver the wash solution to a first manifold bore of said plurality of manifold bores that is located at the upper part of the inclined passageway so that the wash solution flows along substantially an entire length of the inclined passageway from the closed end to the opening; and a supply tube fluidly connected to said inclined solution passageway and located at the lower part of the inclined solution passageway to lead processing solution to the processor.

18. A chemical delivery system according to claim 17, wherein a second one of said chambers is adapted to hold a bleach solution, a third one of said chambers is adapted to hold a fix solution, and a fourth one of said chambers is adapted to hold a developer solution, the fourth one of said chambers adapted to hold the developer solution is further adapted to deliver the developer solution to a second manifold bore of said plurality of manifold bores which is located downstream, with respect to the solution flow direction, of the first manifold bore.

19. A chemical delivery system according to claim 18, wherein both the second one of said chambers adapted to hold a bleach solution and the third one of said chambers adapted to hold a fix solution are further adapted to respectively deliver bleach solution and fix solution to a third manifold bore and a fourth manifold bore of said plurality of manifold bores, said third and fourth manifold bores being located downstream, with respect to the solution flow direction, of the second manifold bore.

20. A method of delivering processing solution to a processor, the method comprising the steps of:

delivering a developer solution to a first inlet bore located on an inclined path provided within a manifold, said manifold providing a fluid connection to a processor, such that the developer solution flows within the inclined path in a solution flow direction from the first inlet bore to an outlet located at a lower end of the inclined path, delivering one of a fix solution or a bleach solution to a second inlet bore located on said inclined path, said second inlet bore being spaced from said first inlet bore and being located downstream of said first inlet bore with respect to said solution flow direction, such that said one of said fix solution or bleach solution flows within said inclined path from said second inlet bore to said outlet located at the lower end of said inclined path;

delivering the other of the fix solution or the bleach solution to a third inlet bore located on said inclined path, said third inlet bore being spaced from said second inlet bore and being located downstream of said second inlet bore with respect to said solution flow direction, such that said other of said fix solution or bleach solution flows within said inclined path from said third inlet bore to said outlet; and delivering a wash solution to a fourth inlet bore located at upper end of said inclined path, said fourth inlet bore being spaced from said first inlet bore and being located upstream of said first inlet bore with respect to the solution flow direction, such that said wash solution flows within said inclined path from the fourth inlet bore to said outlet located at the lower end of the inclined path, said wash solution traveling past all of said first, second and third inlet bores along substantially an entire length of said inclined path.

21. A method of processing photographic material, the method comprising the steps of:

successively delivering distinct processing solutions during a processing cycle to different inlets which are spaced along an inclined path, such that the processing solutions flow within the inclined path to an outlet at the lower end of the inclined path; and leading said distinct processing solutions from said outlet of said inclined path to a processor for processing photographic material;

wherein a last delivered solution of said processing solutions in the processing cycle is a wash solution, the method comprising the further step of delivering the wash solution to an uppermost inlet of said inlets of said inclined path to clean at least the inclined path and components of the processor at the end of the processing cycle.

22. A method according to claim 21, wherein the delivered processing solutions in said processing cycle in addition to said wash solution comprises a developer solution, a fix solution and a bleach solution.

* * * * *